United States Patent [19]

Kurtz

[11] Patent Number: 4,624,018

[45] Date of Patent: Nov. 25, 1986

[54] TOILET FLUSHING APPARATUS

[76] Inventor: John G. Kurtz, 45 Oak Bend La., Rochester, N.Y. 14617

[21] Appl. No.: 717,125

[22] Filed: Mar. 28, 1985

Related U.S. Application Data

[63] Continuation-in-part of Ser. No. 665,706, Oct. 29, 1984, abandoned.

[51] Int. Cl.[4] ..... E03D 1/14

[52] U.S. Cl. ..... 4/325; 4/385; 4/405; 4/415

[58] Field of Search ..... 4/324–325, 4/378–382, 384–387, 392–393, 405, 407, 410, 412, 413, 415

[56] References Cited

U.S. PATENT DOCUMENTS

| | | | |
|---|---|---|---|
| 968,875 | 8/1910 | Morrissey | 4/385 |
| 2,602,934 | 7/1952 | McCormack et al. | 4/324 |
| 2,744,261 | 5/1956 | Gram | 4/324 |
| 2,922,168 | 1/1960 | Crandall | 4/384 |
| 3,036,313 | 5/1962 | Jenkins | 4/324 |
| 3,823,425 | 7/1974 | Coffman | 4/325 |
| 3,831,204 | 8/1974 | Cook | 4/402 |
| 3,945,056 | 3/1976 | Kowalski et al. | 4/325 |
| 4,145,774 | 3/1979 | Sullivan | 4/405 |
| 4,175,296 | 11/1979 | Goldman | 4/405 |
| 4,293,964 | 10/1981 | Riedel | 4/378 |
| 4,406,024 | 9/1983 | Chiu et al. | 4/415 |
| 4,411,029 | 10/1983 | Haung | 4/405 |
| 4,455,694 | 6/1984 | Dymon | 4/393 |
| 4,485,501 | 12/1984 | Kloner | 4/405 |

*Primary Examiner*—Stephen Marcus
*Assistant Examiner*—Linda J. Sholl

[57] ABSTRACT

Apparatus for selectively dispensing either of two different volumes of water from a water closet comprises a mechanism for latching a valving member (e.g. a flapper valve) in a position just short of a threshold position at which it would normally "flip" to its full flush position, and for unlatching such member, after a predetermined quantity of water has flowed from the tank, to allow it to return to its closed (sealing) position.

24 Claims, 11 Drawing Figures

10

TOILET FLUSHING APPARATUS

CROSS-REFERENCE TO RELATED APPLICATIONS

This application is a continuation-in-part application of U.S. application Ser. No. 665,706, filed on Oct. 29, 1984, now abandoned.

BACKGROUND OF THE INVENTION

The present invention relates to toilet flushing apparatus of the type capable of selectively dispensing either of two different volumes of water from a water closet.

The desirability of conserving water in the household is ever-increasing for water, in most parts of the world, is becoming less plentiful and, hence, more expensive. The single largest water-consumption device in the household is, of course, the toilet. Typically, with every flick of the finger, between three and seven gallons of water is consumed when, on the majority of occasions, only about half that amount need be used to fully refresh and replenish the toilet bowl. Being such a notorious water guzzler, is there any wonder that literally hundreds of inventors have focused attention over the years on devising apparatus by which either a full flush or a reduced flush can be readily achieved? Certainly the patent literature is repleat with so-called "dual flush" devices which reflect their noble efforts. Notwithstanding the apparent need, no dual flush device devised to date has received widespread commercial acceptance.

In U.S. Pat. No. 3,945,056, for example, there is disclosed a "modification kit" by which a conventional toilet of the flush tank type may be converted to a dual flush system. This conversion kit is advantageous from the standpoint that it makes use of most of the components of a conventional flushing system, including the flushing handle mounted on the outside of the water closet (flush tank). For a partial flushing, the operator merely depresses and releases the flush handle in the normal manner. When this is done, a flapper valve is removed from a valve seat to a position in which it floats above the valve seat. After a predetermined volume of water passes through the valve seat and enters the toilet bowl, a rather complex mechanism engages the flapper valve and positively urges it toward its sealing position in which it prevents further escape of water from the tank. For a full flush, the user is required to depress the flush handle and, rather than release it, he must pull it upwardly, thereby disabling, by a comparably complex second mechanism, the mechanism which would otherwise produce a partial flush. Aside from the complexity of the system per se, the requirement for the user to operate the flush lever in a non-conventional (push down/pull up) manner is disadvantageous.

While other inventors have devised dual flush mechanisms which are mechanically simpler than that mentioned above, such systems cannot be readily adapted to make use of the existing hardware of conventional water closets, and none has proven so reliable and low-cost as to be commercially viable.

SUMMARY OF THE INVENTION

In view of the foregoing, an object of this invention is to provide a low-cost and reliable apparatus for selectively dispensing either of two different volumes of water from the water closet of a conventional flush toilet.

Another object of this invention is to provide dual flush apparatus in which, to achieve either a full or partial flush, a flush handle is merely depressed and released in a conventional manner.

Still another object of this invention is to provide a two-element flush handle which is useful in activating the dual flush apparatus of the invention.

A further object of this invention is to provide a dual flush apparatus which can be readily retro-fitted into existing water closets of the type having either a flapper valve, or a vertical float-controlled valve for controlling the flow of water from the water closet.

The above objects of the invention are achieved by a dual flush apparatus which cooperate with a movably mounted valving member (e.g. flapper or vertical float valve) which is adapted to selectively seal the outlet of a water closet. Such apparatus comprises manually operable means for selectively moving the valving member between a rest position, in which it allows the valving member to seal the water closet outlet, and either (i) a first operative position in which the valving member is sufficiently spaced from the outlet that substantially all the water in the water closet flows through the outlet notwithstanding removal of the displacement force, or a second operative position directly above and closely spaced from the outlet in which such member will immediately return to its sealing position in response to a removal of the displacement force. Latching means are provided for selectively (a) latching the valving member in its second operative position until a predetermined volume of water has passed through the outlet and (b) unlatching such valving member to allow its return to its sealing position. Preferably, movement of the lever arm to either its first or second operative positions is controlled by a manually operated flush handle having first and second elements which are mounted for pivot movement about a common axis. Pivotal movement of the first element causes the valving member to move to its first operative position; and pivotal movement of the second element causes the valving member to move to its second operative position. Stop means, operatively coupled to the second element of the flush handle, are provided for preventing the valving member from moving beyond the second operative position when the second handle element is pivoted. Also preferred is that a small weight be operatively connected to the valving member to prevent such valving member from moving past the first operative position, by its own momentum, in response to a quick movement of the second handle element.

The invention and its various advantages will become immediately apparent to those skilled in the art from the ensuing detailed description of a preferred embodiment, reference being made to the accompanying drawings in which like reference characters designate like parts.

Figure 1:
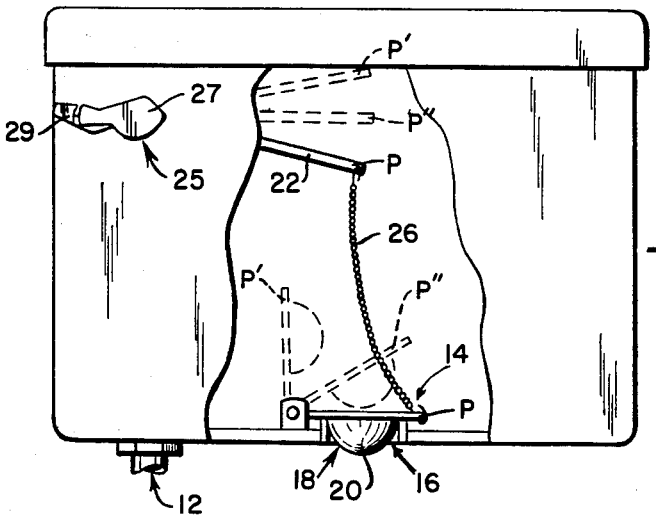
FIG. 1 is a side elevation, partially cut-away, illustrating a water clost embodying the present invention.
Figure 7:
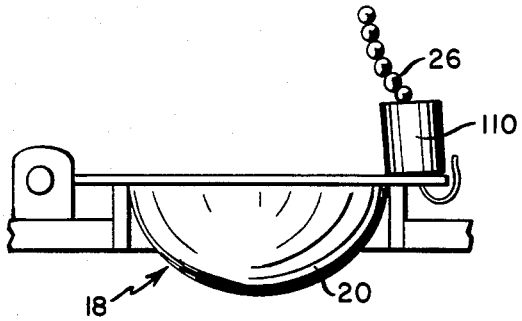
Figure 8:
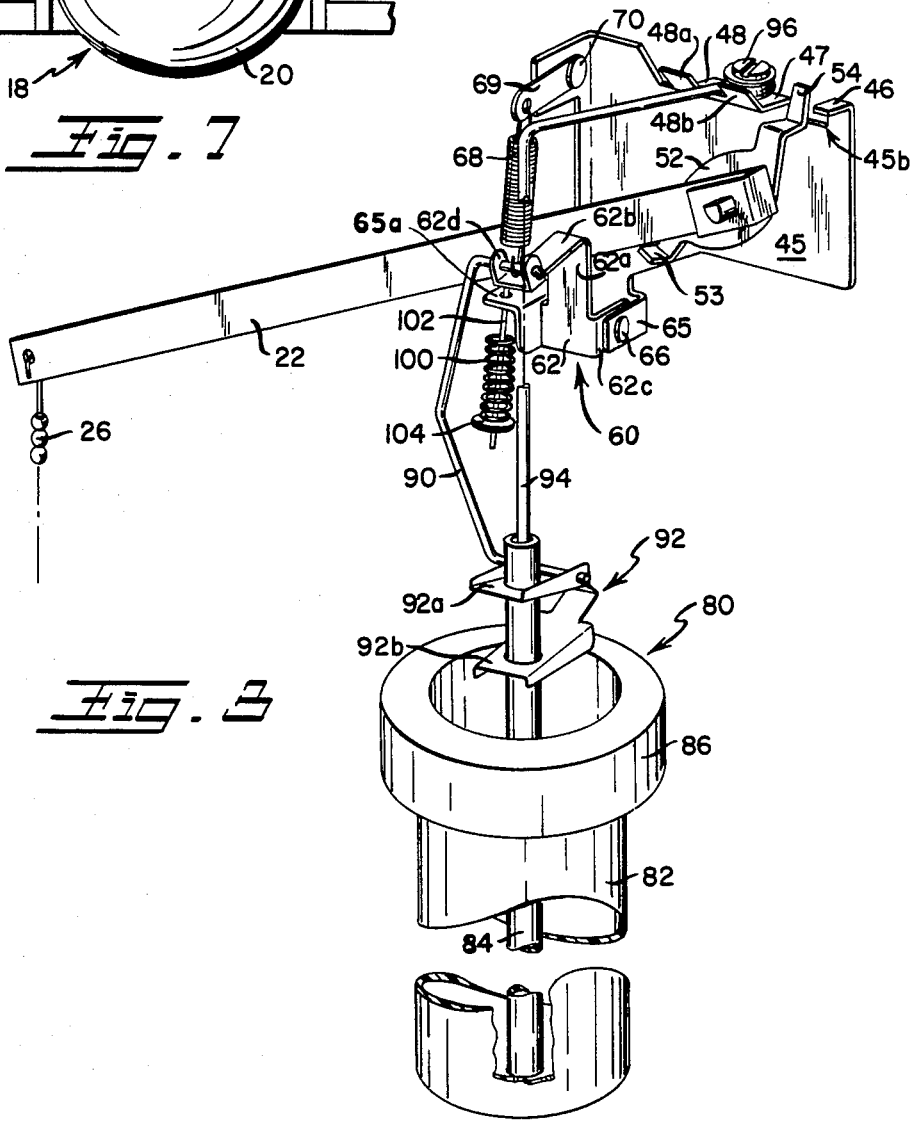
Figure 4:
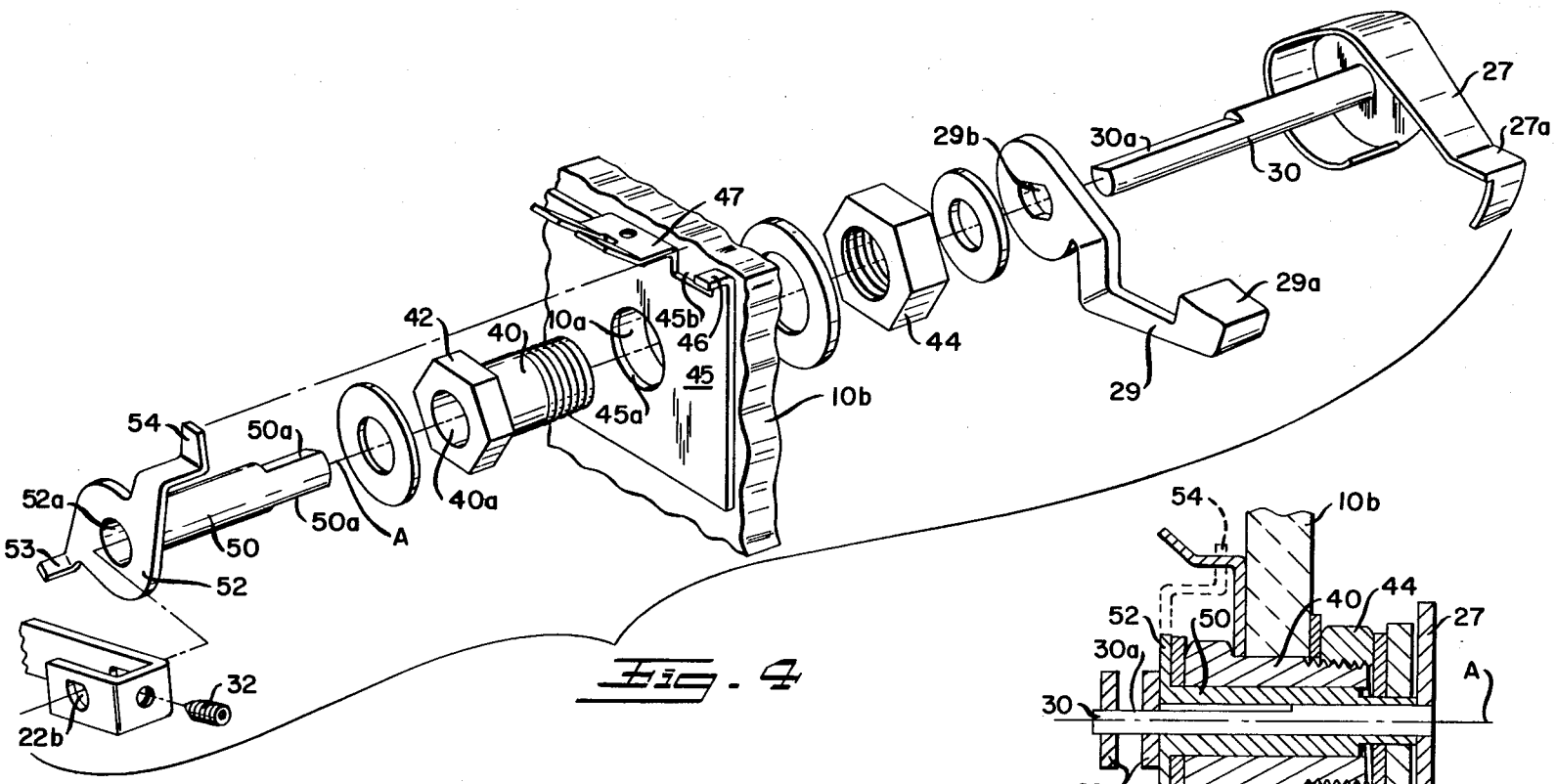
Figure 5:
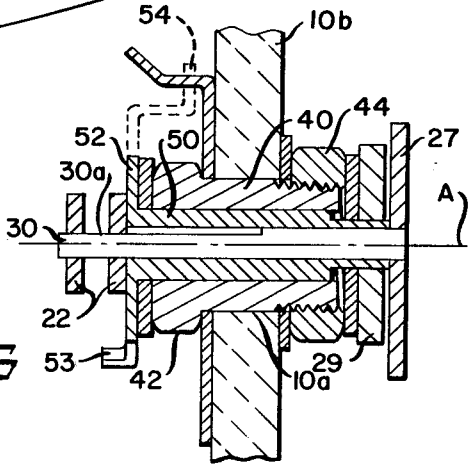
Figures 6A, 6B, 6C:
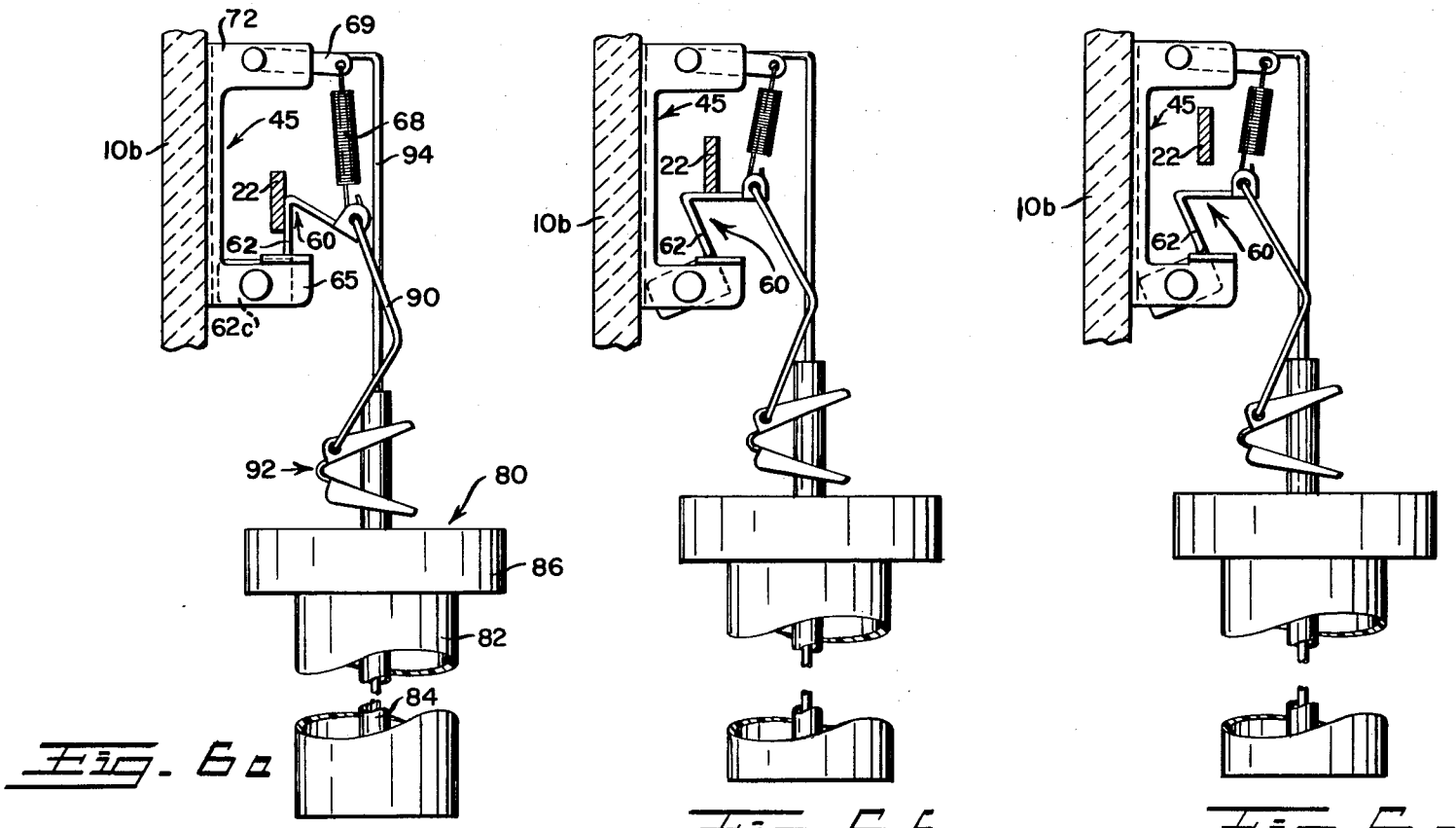

FIGS. *2a–2c* illustrate various positions of a two-part flush handle useful in actuating the flush apparatus of the invention;

FIG. 3 is a perspective view of a preferred embodiment of the toilet flushing apparatus of the invention;

FIG. 4 is an exploded perspective view of a portion of the FIG. 3 apparatus;

FIG. 5 is a cross-sectional view of the apparatus shown in FIG. 3 taken along the section line 5—5;

FIGS. 6a–6c are side elevational views, partically in cross section, showing various positions of components of the FIG. 3 apparatus at different stages of operation; and FIG. 7 is a close-up view of a portion of the FIG. 1 apparatus.

DETAILED DESCRIPTION OF A PREFERRED EMBODIMENT

Referring now to the drawings, FIG. 1 illustrates a conventional water closet 10 incorporating a preferred embodiment of the invention. On demand and in a well-known manner, water enters the closet through inlet 12 and fills to a predetermined level, typically two-thirds to three-fourths full. Flow of water out of the closet to a toilet bowl is controlled by a dump valve 14 comprising a valve seat 16 and a cooperating movable valving member 18, shown here as a flapper-type valving member. It will be clear from the ensuing description that the valving member 18 may take a variety of forms, such as a vertically movable stopper ball. It is the apparatus which controls the movement of this valving member which constitutes the invention.

As shown in FIG. 1, valving member 18 is movable (in this case pivotal) from a rest position p in which its plug portion 20 mates with valve seat and thereby prevents water from flowing from the closet (shown in solid lines) to different operative positions, e.g. p′ and p″, in which such plug portion is removed from the valve seat to varying degrees, thereby allowing water to flow from the closet. Movement of the valving member from its rest position to its operative positions is controlled by a movably mounted lever arm 22, the position of which is controlled by a two-element flush handle 25 (best shown in FIGS. 2a–2c and described in detail below). A chain 26 operatively connects one end of lever arm 22 with the valving member. When the lever arm is in its rest position p (shown in solid lines), chain 26 only loosely connects the lever and the valving member, allowing the latter to assume, via gravity and the weight of the water above it, its rest position. As the lever arm is moved to its uppermost operative position p′, the chain becomes taut and causes the valving member to move to its fully open position p′ (shown in phantom).

It has been observed that, as valving member 18 gradually moves from its rest position to its full open position, there is a threshhold position (e.g., P″ in FIG. 1) beyond which it will suddenly move to its full open position p′ and remain there until the water closet empties. Until the valving member has reached this threshhold position, however, it will immediately return to its rest (i.e. sealing) position P upon removal of the displacement force (exerted by chain 26 via lever 22 and handle 25). What accounts for this sudden and irreversible movement of the valving member is the gradual increase in flow rate through the valve seat caused by the gradual increase in separation between the valving member and the valve seat. As this flow rate increases, the ever-increasing force of the water rushing through the valve seat eventually exceeds the re-seating force (exerted by gravity and the water above the valving member) on the valving member. At this point, the valving member "flips" to its full open position and, notwithstanding the return of the lever arm 22 to its rest position (which would normally allow the valving member to return to its rest position), water will flow from the closet until the re-seating forces (gravitational and other) once again exceed the force exerted by the water flow, at which time the water closet is virtually empty.

The dual flush apparatus of the invention makes use of the above observation in that, when operating in a full flush mode, it allows the valving member 18 to move, in a conventional manner, through (and beyond) its threshhold position and, when operating in a partial flush mode, it not only prevents the valving member from exceeding such threshhold position, but also functions to latch the valve member in a position short of the threshhold position until a desired amount of water flows from the tank, and then unlatches the valving member, allowing the gravitational forces to return such member to its rest and sealing position.

Figure 2A:
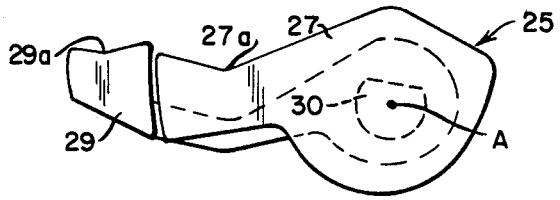
Figure 2B:
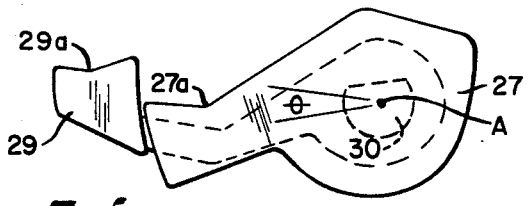
Figure 2C:
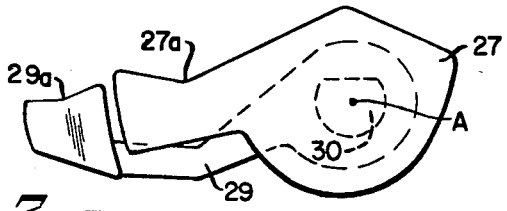

Referring now to FIGS. 2a–2c, flush handle 25 is shown to comprise first and second handle elements 27, 29, respectively, which are independently mounted for limited pivotal movement about a common axis A. In FIG. 2a, both handle elements are shown in a rest position, i.e. prior to initiating a flush cycle. When the first handle element 27 is pivoted counterclockwise about axis A, such as by manual depression at indentation 27a, to the position shown in FIG. 2b, a shaft 30 to which element 27 is rigidly coupled, is rotated through a predetermined angular range $\theta$. This causes lever arm 22 (in FIG. 1) to swing upwardly, in a conventional manner, from position p to position p′. The result will be an emptying (i.e. full flush) of the water closet for the reasons discussed above. When the second handle element 29 is pivoted (e.g. by manual depression of tab 29a) to the position shown in FIG. 2c, lever arm 22 will move to a position just short of the threshold position p″, the result being a partial flush from the water closet. How these results are achieved will now be explained.

Referring now to FIGS. 3–5, it will be seen that lever arm 22 is mounted to rotate with shaft 30 by virtue of the engagement between the shaft's flattened portion 30a and a pair of mating apertures 22b formed in a folded-back portion of one end of lever arm 22. A set screw 32 determines the axial position of lever arm 22 on shaft 30. The opposite end of shaft 30 is rigidly coupled to handle element 27, as best shown in FIG. 4. Thus, it will be seen that rotational movement of shaft 30, as occasioned by pivotal movement of handle element 27, will cause lever arm 22 to pivot about axis A. Since there is nothing to retard the movement of the lever arm, it will pass through and beyond the threshold position p″ and thereby produce a full flush.

In FIGS. 4 and 5, it will be seen that the flush handle assembly 25 and its associated hardware are supported in an aperture 10a formed in the water closet wall 10b by a threaded bushing 40 having a nut 42 rigidly affixed at one end and a removable nut 44 at the other. The threaded exterior surface of bushing 40 supports a mechanism plate 45 (discussed below), having an aperture 45a through which the bushing passes. When nut 44 is tightened, the mechanism plate is firmly positioned against the interior wall of the water closet. A strip of double-faced tape positioned between the closet wall and the mech plate will prevent any rotational movement of the mech plate about the outer surface of the bushing.

As best shown in FIG. 5, the interior surface of bushing 40 rotatably supports a hollow shaft 50. The interior of shaft 50, in turn, rotatably supports shaft 30. Affixed to one end of hollow shaft 50 is a washer-shaped plate 52 having an aperture 52*a* which is concentric with the bore of shaft 50 and allows shaft 30 to pass therethrough. The free end of hollow shaft 50 is provided with flattened opposing surfaces 50*a*, and handle element 29 is provided with an aperture 29*b* which is shaped to receive the flattened end of shaft 50. Thus, it will be appreciated that pivotal movement of handle 29 about axis A will cause rotational movement of shaft 50. From FIG. 5, it will be seen that the entire handle assembly is clamped between lever arm 22 and handle element 27 and held in place by set screw 32.

Referring to FIGS. 3 and 4, it will be seen that the washer-shaped plate 52 is provided with a pair of tabs 53, 54. Tab 53 is positioned to engage and provide an upward force on the bottom edge of arm 22 as shaft 50 rotates. In this manner, lever arm 22 is caused to pivot counterclockwise (as viewed in FIG. 1) about axis A as handle element 29 is pivoted in the same direction. As stated above, in achieving a partial flush in accordance with the basic concept of the invention, it is essential that the lever arm 22 not be permitted to reach the threshold position beyond which a full flush is inevitable. To help achieve this result, tab 54 is positioned to be trapped by a notch 45*b* defined by a pair of stop members 46, 47, in mech plate 45. Thus, as plate 52 rotates counterclockwise (in FIG. 1), under the force exerted by the manually depressed handle element 29, tab 54 engages stop member 46 and, in this manner, tab 53 is prevented from raising the lever arm 22 beyond the threshold position. Stop member 47 is provided merely to prevent handle element 29 from rotating clockwise beyond the rest position shown in FIG. 2A.

An important aspect of this invention is that of latching the flush lever arm 22 in a partial flush position while the water closet partially empties, and of automatically unlatching this lever arm after the partial flush has been completed to allow the valving member to return to its sealing position in the valve seat. Such latching and unlatching is accomplished by the latching device 62 shown best in FIGS. 3 and 6*a*–6*c*. The latching function is preferably achieved by a spring-biased, pivotally mounted, latching lever 62, described below.

Latching lever 62 is a unitary structure, preferably made of sheet metal. It comprises a pair of legs 62*a*, 62*b* which are angularly disposed relative to each other, each leg having a pair of bent tabs extending outwardly therefom. Tabs 62*c* extend rearwardly of leg 62*a* and serve to movably mount the latching lever for pivotal movement about a pivot pin 66 supported by a pair of tabs 65 extending outwardly from mech plate 45. The length of at least one of tabs 62*c* is such that, during movement of the latching lever to its latching position (shown in FIG. 6B), its leading edge engages the mech plate 45 and prevents further movement in the latching direction. Tabs 62*d* extend upwardly from leg 62*b* and serve to support one end of a rod 90 which, as discussed below, connects the latching lever 62 to a float 80 (which comprises an unlatching mechanism, discussed below). A spring 68, connected between the latching lever and an adjustable arm 69 extending outwardly from mech plate 45, serves to bias the latching lever about pivot pin 66 toward engagemenet with lever arm 22. The tension in the spring and, hence, the biasing force, may be altered by varying the angular position of arm 69 about a support pin 70.

Referring to FIG. 6A, when the system is at rest, lever 22 is in its lowermost position (i.e. position p in FIG. 1). At this time, the upwardly extending leg 62*a* of the latching lever is urged by spring 68 into contact with the side of lever arm 22. If desired, a stainless steel bearing surface (not shown) can be fitted onto the lever arm at the point of contact by latching lever 62 to reduce wear and minimize friction. When either of the flush handle elements 27 or 29 is depressed, lever arm 22 will be lifted to either the position shown in FIG. 6B (i.e. a partial flush) or to the position shown in FIG. 6C (i.e. a full flush). In either case. as soon as lever arm 22 clears the top of leg 62*a* of latching lever 62, spring 68 will act to pivot the-latching lever to its operative, i.e. latching, position (shown in FIG. 6B) in which leg 62*b* is positioned beneath the lever arm.

As mentioned earlier, when handle element 29 is depressed, lever arm 22 will move to a position just short of its threshold position p″ shown in FIG. 1. It is prevented from moving beyond this position by virtue of tab 54 engaging stop 46. After the lever arm reaches its partial flush position, it is latched there by latching lever 62, as shown in FIG. 6B. In order to unlatch the latching lever after a desired amount of water flows from the water closet, thereby allowing the valving member to return to its sealing position, a weight 80 is operatively coupled to the latching lever by a bendable (for adjustment purposes) connecting rod 90. Weight 80 generally comprises a hollow container 82 having a centrally located hollow tube 84 extending vertically upward from its base. An annular skirt 86 surrounds the top of the container and hangs downardly therefrom. As mentioned above, one end of connecting rod 90 is supported by tabs 62*d* of the latching lever. The other end of the connecting rod is connected to the hollow tube 84 by a clamp 92 comprising a pair of angularly disposed flexure members 92*a*, 92*b* which, when squeezed together, allow the position of the clamp to be varied with respect to the tube. As the clamp moves up and down the tube, connecting rod 90 will be bent to greater and lesser extents. The purpose for the adjustment is to position the float below water level in the water closet so that container 82 is always filled with water. A float guide wire 94, connected to the mech plate by screw 96, extends vertically downwardly and into the interior of tube 84, and functions to guide the vertical movement of the float.

In operation, after lever 22 has been latched in its partial flush position p″ (shown in FIG. 6B), water will flow through valve seat 16. As the water level drops in the water closet, weight 80 will gradually lose its buoyancy. The result will be a gradual increase in the downward force on the latching lever 62. Eventually, the weight of the container will unlatch the latching lever, allowing the lever arm 22 to return to its rest position p. It should be noted that the extent to which the water closet empties during a partial flush may be readily controlled by merely varying the angular position of arm 69 which supports spring 68. When arm 69 is pivoted upwardly, spring 68 will be extended beyond its nominal position and the force it exerts on the latching lever to move it toward its operative (latching) position will be increased. Thus, unlatching of the latching lever will require a corresponding force, such force being provided by the weight of the container after the water level has dropped below the nominal partial flush level. Similarly, a relatively small partial flush can be achieved by merely reducing the tension in spring 68, by moving arm 69 to a lower position.

After the latching lever 62 has been unlatched, lever arm 22 will drop to its rest position p, thereby allowing the valving member 14 to return to its sealing position in valve seat 16. At this time, the water closet will begin to refill. As the water closet refills, weight 80 again becomes buoyant, allowing the force of spring 68 to bias the latching lever into contact with the side of lever arm 22 (as shown in FIG. 6*a*). Air trapped in the containers skirt 86 enhances the biasing force provided by spring 68 and assures the movement of latching lever 62 to its latching position (shown in FIG. 6*b*) as soon as lever arm 22 is raised to a partial flush position. As shown in FIG. 6*c*, latching lever 62 moves to its latching position even when lever arm 22 is in a full flush position.

To prevent the lever arm 22 from moving, via its own inertia, through the threshold position p″ in response to a sudden and forceful depression of the partial flush handle element 29, a compressible damper spring 100 is provided. Damper spring 100, best shown in FIG. 3, surrounds a rod 102 having a pad 104 fixed at one end thereof. The other end of rod 102 passes through an aperture 106 formed in a flange 65*a* extending outwardly from tab 65 and is connected to lever arm 22 at an intermediate point. Thus, as the lever arm moves upwardly, the damper spring 100 is compressed between pad 104 and flange 65*a*. The length of the spring and spring constant are selected to prevent the lever from moving (via inertia) through the threshold position after tab 54, on plate 52, has engaged stop member 46, yet allow the lever arm to move to position p′ when the full flush handle element is depressed. To prevent the flapper valve from "floating" past its threshold position via the inertia produced by a rapid movement of handle element 29, a small weight (shown in FIG. 7) is preferably arranged atop the flapper valve 14. Such weight may comprise, for example, a $\frac{3}{8}$–$\frac{3}{4}$ oz. barrel-shaped member which is positioned to surround the lift chain 26, as shown. Such weight acts to retard movement of the flapper valve as it is raised by lever arm 22.

The invention has been disclosed with particular reference to a preferred embodiment. It will be understood, however, that various modifications may be made without departing from the spirit and scope of the invention, as defined by the appended claims.

What is claimed is:

1. Toilet flushing apparatus for selectively dispenaing either of two different volumes of water through an outlet formed in the base of a water closet, said water closet including a movably mounted valving member for selectively closing and opening such outlet to respectivelv prevent and allow the passage of water therethrough, said apparatus comprising:

(a) manually operable means for applying a displacement force to said valving member to selectively move said member from a rest position, in which it closes said outlet, to either (i) a first position which is so far displaced from the outlet that said valving member will not return to its rest position, notwithstanding removal of such displacement force, until substantially all the water in the water closet passes through the outlet, or (ii) a second position directly above and closely spaced from the outlet in which said valving member will immediately return to its rest position in respnse to removal to such displacement force, said manually operable means comprising a movably mounted lever arm operatively coupled to said valving member, and handle means for selectively moving said lever arm upwardly from a rest position through first or second different displacement ranges to cause said valving member to move from its rest position to either said its first or second position, respectively; and (b) latching means for selectively latching said valving menber in said second position until a predetermined volume of water has passed throuch the outlet, and for unlatching said member thereafter to allow said member to return to its rest position.

2. The apparatus as defined by claim 1 wherein said handle means comprises first and second elements which are mounted for pivotal movement about a common axis, pivotal movement of said first element causing said lever arm to move through said first displacement range, and pivotal movement of said second element causing said lever arm to move through said second displacement range.

3. The apparatus as defined by claim 2 fruther comprising stop means for preventing said second handle element from pivoting beyond a position which would cause said valving member to move beyond its second position when said second handle element is pivoted.

4. The apparatus as defined by claim 3 wherein said stop means comprises means for preventing the valving member from moving, via inertia, beyond said second position in resoonse to sudden movement of said one handle element.

5. The apparatus as defined by claim 4 wherein said preventing means comprises a damper spring.

6. The apparatus as defined by claim 2 further comprising means for retarding the movement of said valving member to prevent said valving member from moving, via inertia, beyond said first position in response to a rapid movement of said first handle element.

7. The apparatus as defined by claim 6 wherein said retarding means comprises a weight positioned atop the valving member.

8. The apparatus as defined by claim 1 wherein said lever arm, upon movement through one of said displacement ranges, functions to support said valving member in its second position.

9. The apparatus as defined by claim 8 wherein said latching means comprises means for latching said lever arm upon movement thereof through said second displacement range.

10. The apparatus as defined bv claim 9 wherein said latching means comprises a pivotally mounted latching lever which is movable between an unlatching position adjacent said lever arm, and a latching position in which it underlies and supports said lever arm after said lever arm has moved through said first displacement range, and spring biasing means for urging said latching lever toward said latching position.

11. The apparatus as defined by claim 10 wherein said latching means further comprises means for urging said latching lever out of said latchinc position after a predetermined volume of water has passed through the water closet outlet.

12. The apparatus as defined by claim 11 wherein said urging means comprises a weight which is suspended in the water closet below water level, said weight gradually losing its buoyancy as water passes through said outlet, causing said lever to unlatch and return to its rest position when said predetermined volume of water passes through said outlet, at which time the force exerted by said weight exceeds the force exerted by said biasing means.

13. The apparatus as defined by claim 12 wherein said weight comprises a water-filled container.

14. The apparatus as defined by claim 12 further comprising means for adjusting the vertical position of said weight.

15. The apparatus as defined by claim 10 further comprising means for adjusting the force provided by said biasing means, whereby said predetermined volume of water is variable.

16. Toilet flushing apparatus for selectively dispensing either of two different volumes of water through an outlet formed in the base of a water-filled water closet, said water closet including a movably mounted valving member for selectively closing and opening such outlet to respectively prevent and allow the passage of water therethrough, said valving member being of the type which (a) in response to a first displacement force will move to and beyond a threshold position at which the valving member will not return to its rest position, notwithstanding the removal of the displacment force, until the major portion of the water in the said closet has passed through said outlet, and (b) in response to a lesser second displacement force will move from a rest position to a position short of said threhold position, said valving member immediately returning to its rest position, via gravity, upon removal of such second displacement force, said apparatus comprising:

manually operable means for selectively exerting either of said first or second displacement forces on said valving member, said manually operable means comprising a lever arm mounted for pivotal movement about a horizontal axis, a chain connecting one end of said lever arm and the valving member, and handle means for selectively pivoting said lever arm so that one end of the lever arm moves from a rest position through first or second displacement ranges, whereby said first or second displacement forces, respectively, are exerted on said valving member; and latching means, responsive to said manually operable means having exerted said lesser second displacement force, for latching said valving member in a position short of said threshold position, and for unlatching said valving member after a pretermined volume of water has passed through said outlet to allow said valving member to immediatedly return to its rest position.

17. The apparatus as defined by claim 16 wherein said handle means comprises first and second handle elements which are mounted for independent movement about a common axis, pivotal movement of said first element causing said lever arm to move through said first displacement range, and poivotal movement of said second element causing said lever arm to move through said second displacement range.

18. The apparatus as defined by claim 17 further comprising stop means for preventing pivotal movement of said second element beyond said second displacement range.

19. The apparatus as defined by claim 16 wherein said latching means comprises a pivotally mounted latching-lever, means for biasing said latching-lever toward a latching position in which it will underlie and support said lever arm after said lever arm has moved through said second displacement range.

20. The apparatus as defined by claim 19 wherein said latching means further comprises means for urging said latching lever out of said latching position after a predetermined volume of water has passed through the water closet outlet.

21. The apparatus as defined by claim 20 wherein said urging means comprises a weight which is suspended in the water closet below water level, said weight gradually losing its buovancy as water passes through said outlet, causing said lever to unlatch and return to its rest position when said predetermined volume of water gasses through said outlet, at which time the water exerted by said weight exceeds the force exerted by said biasing means.

22. The apparatus as defined by claim 21 wherein said weight comprises a water-filled container.

23. The apparatus as defined by claim 21 further comprising means for adjusting the vertical position of said weight.

24. The apparatus as defined by claim 19 further comprising means for adjusting the force provided by said biasing means whereby said predetermined volume of water is variable.

* * * * *